US009597691B1

(12) United States Patent
Hockmeyer et al.

(10) Patent No.: US 9,597,691 B1
(45) Date of Patent: Mar. 21, 2017

(54) PRODUCING PARTICLE DISPERSIONS

(71) Applicant: Hockmeyer Equipment Corp., Harrison, NJ (US)

(72) Inventors: Herman H. Hockmeyer, Saddle River, NJ (US); Barry W. Cullens, Elizabeth City, NC (US)

(73) Assignee: Hockmeyer Equipment Corp., Harrison, NJ (US)

( * ) Notice: Subject to any disclaimer, the term of this patent is extended or adjusted under 35 U.S.C. 154(b) by 0 days.

(21) Appl. No.: 15/179,507

(22) Filed: Jun. 10, 2016

(51) Int. Cl.
*B02C 23/18* (2006.01)
*B02C 19/00* (2006.01)
*B02C 19/18* (2006.01)

(52) U.S. Cl.
CPC ..... *B02C 23/18* (2013.01); *B02C 19/0018* (2013.01); *B02C 19/186* (2013.01)

(58) Field of Classification Search
CPC .... B02C 23/18; B02C 19/186; B02C 19/0018
USPC ..... 241/172, 74
See application file for complete search history.

(56) References Cited

U.S. PATENT DOCUMENTS 8,376,252 B1 2/2013 Hockmeyer et al.

*Primary Examiner* — Mark Rosenbaum
(74) *Attorney, Agent, or Firm* — Arthur Jacob

(57) ABSTRACT

An improvement in an apparatus and a method produces a particle dispersion by processing a particle-carrying feedstock passed from a supply vessel through a bed of media contained within a containment wall having an inlet end and a longitudinally opposite terminal end. An auxiliary chamber surrounds the containment wall so that the feedstock is passed from the bed of media, through the containment wall and into the auxiliary chamber while the media is contained within the bed of media. An external pumping mechanism established a pressure differential that draws the feedstock into the containment wall and through the bed of media, then through the containment wall into the auxiliary chamber, and then out of the auxiliary chamber at a location juxtaposed with the containment wall between the inlet end and the terminal end, while maintaining a negative pressure within the supply vessel and within the auxiliary chamber during processing of the feedstock.

18 Claims, 3 Drawing Sheets

PRODUCING PARTICLE DISPERSIONS

The present invention relates generally to producing dispersions of finely divided particles within a liquid carrier and pertains, more specifically, to an improvement and method for processing particle-carrying feedstock passed through a bed of media contained within a containment wall of a processing apparatus.

Conventional mills of the type in which particle-carrying feedstock is passed through a bed of media contained within a containment wall have been in use for a very long time and have demonstrated an ability to produce high quality particle dispersions with consistent reliability. More recent improvements, such as those described in U.S. Pat. No. 8,376,252, the disclosure of which is incorporated herein by reference thereto, have proved to provide further advances in the attainment of finer dispersions of consistent high quality, with reduced processing times.

The present invention provides improvements apparatus and methods that attain dramatic increases in equipment performance and product quality. As such, the present invention attains several objects and advantages, some of which are summarized as follows: Processes a higher volume of particle-carrying feedstock in less time to produce particle dispersions of increased, high quality; increases the effectiveness of processing a particle-carrying feedstock utilizing a bed of media contained within a containment wall through which the feedstock is passed; enables a dramatic increase in throughput of feedstock with a concomitant reduction in processing time; attains consistent high quality in particle dispersions processed in greater volumes and less processing time; avoids the emanation of unwanted gases and other potential pollutants that can be generated during the processing of a particle-carrying feedstock; simplifies the construction and operation of particle dispersion processing apparatus for increased economy and long-term reliability.

The above objects and advantages, as well as further objects and advantages, are attained by the present invention which may be described briefly as an improvement in an apparatus for producing a particle dispersion utilizing a mill having a rotor mounted for rotation within a containment wall for processing particle-carrying feedstock passed from a supply vessel into a bed of media contained within the containment wall, the improvement comprising: an auxiliary chamber having a chamber wall surrounding the containment wall such that feedstock will pass from the bed of media, through the containment wall and into the auxiliary chamber while the media is contained within the bed of media; a vacuum mechanism for maintaining a first negative pressure within the supply vessel; and an external pumping mechanism communicating with the auxiliary chamber and establishing a pressure differential for drawing the particle-carrying feedstock from the supply vessel, into the bed of media, thence from the bed of media through the containment wall into the auxiliary chamber, and then out of the auxiliary chamber for return to the supply vessel, the pressure differential including a second negative pressure established within the auxiliary chamber during the processing of the particle-carrying feedstock, the second negative pressure being lower than the first negative pressure.

In addition, the present invention provides an improvement in an apparatus for producing a particle dispersion utilizing a mill having a rotor mounted for rotation within a containment wall for processing particle-carrying feedstock passed from a supply vessel into a bed of media contained within the containment wall, the containment wall extending longitudinally between an inlet end and a longitudinally opposite terminal end, the improvement comprising: an auxiliary chamber having a chamber wall surrounding the containment wall such that particle-carrying feedstock will pass from the bed of media, through the containment wall and into the auxiliary chamber while the media is contained within the bed of media; and an external pumping mechanism communicating with the auxiliary chamber at a location juxtaposed with the containment wall between the inlet end and the terminal end of the containment wall, for drawing the particle-carrying feedstock from the supply vessel, into the bed of media, thence from the bed of media through the containment wall into the auxiliary chamber, and then out of the auxiliary chamber and returned to the supply vessel, during the processing of the particle-carrying feedstock.

Further, the present invention provides a method for producing a particle dispersion utilizing a mill having a rotor mounted for rotation within a containment wall for processing particle-carrying feedstock passed from a supply vessel into a bed of media contained within the containment wall, the method comprising: surrounding the containment wall with an auxiliary chamber having a chamber wall such that particle-carrying feedstock will pass from the bed of media through the containment wall and into the auxiliary chamber while the media is contained within the bed of media; maintaining a first negative pressure within the supply vessel; and establishing a pressure differential for drawing the particle-carrying feedstock from the supply vessel into the bed of media, thence from the bed of media through the containment wall, and then out of the auxiliary chamber for return to the supply vessel, the pressure differential including a second negative pressure established within the auxiliary chamber during the processing of the particle-carrying feedstock, the second negative pressure being lower than the first negative pressure.

Still further, the present invention provides a method for producing a particle dispersion utilizing a mill having a rotor mounted for rotation within a containment wall for processing particle-carrying feedstock passed from a supply vessel into a bed of media contained within the containment wall, the containment wall extending longitudinally between an inlet end and a longitudinally opposite terminal end, the method comprising: surrounding the containment wall with an auxiliary chamber having a chamber wall such that particle-carrying feedstock will pass from the bed of media, through the containment wall and into the auxiliary chamber while the media is contained within the bed of media; and establishing a pressure differential for drawing the particle-carrying feedstock from the supply vessel into the bed of media, thence from the bed of media through the containment wall into the auxiliary chamber, and then out of the auxiliary chamber at a location juxtaposed with the containment wall between the inlet end and the terminal end of the containment wall for return to the supply vessel during the processing of the particle-carrying feedstock.

The invention will be understood more fully, while still further objects and advantages will become apparent, in the following detailed description of preferred embodiments of the invention illustrated in the accompanying drawing, in which.

Figure 1:
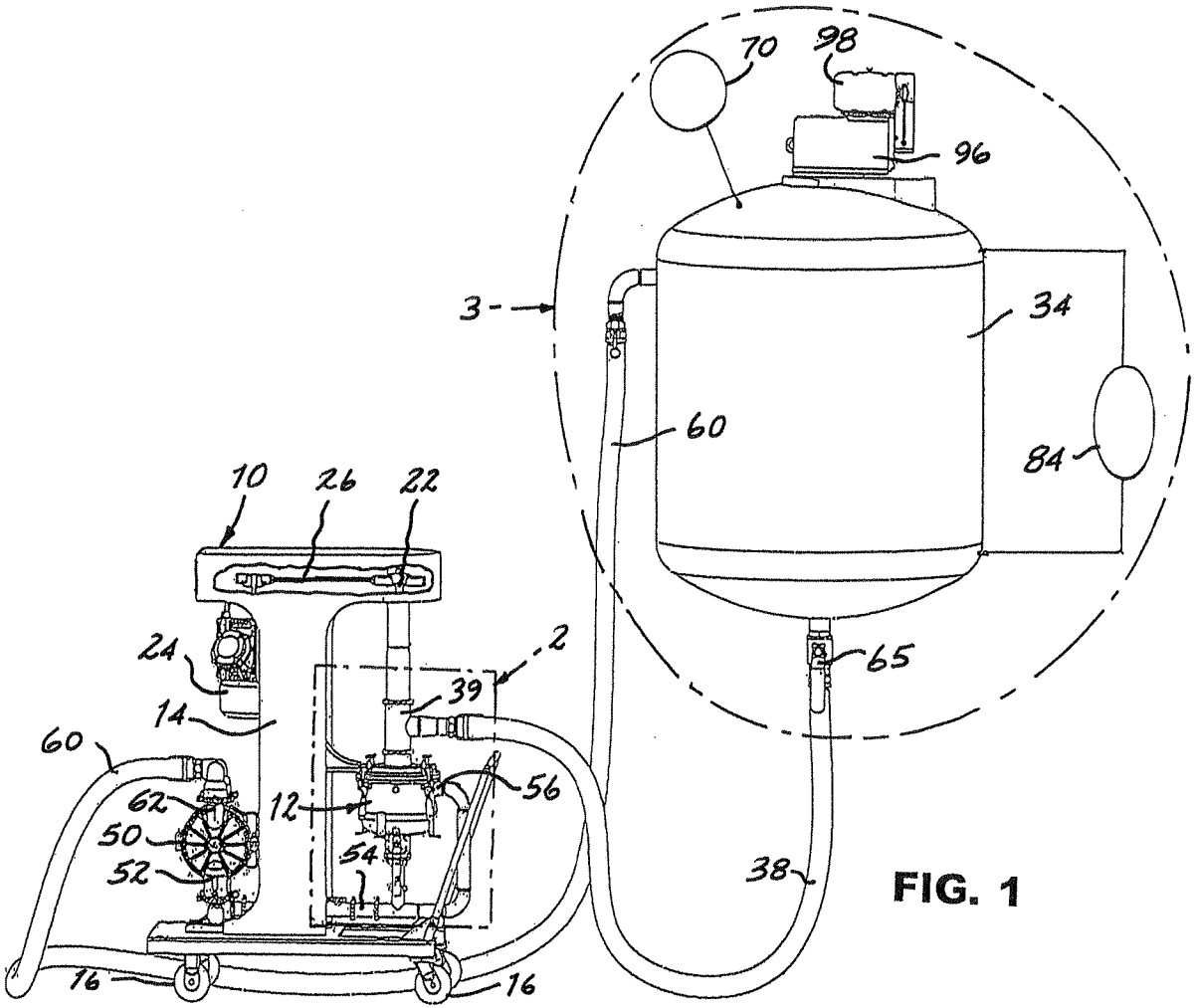
FIG. 1 is an elevational view, partially diagrammatic, of an apparatus incorporating improvements of the present invention and operating in accordance with methods of the present invention.
Figure 2:
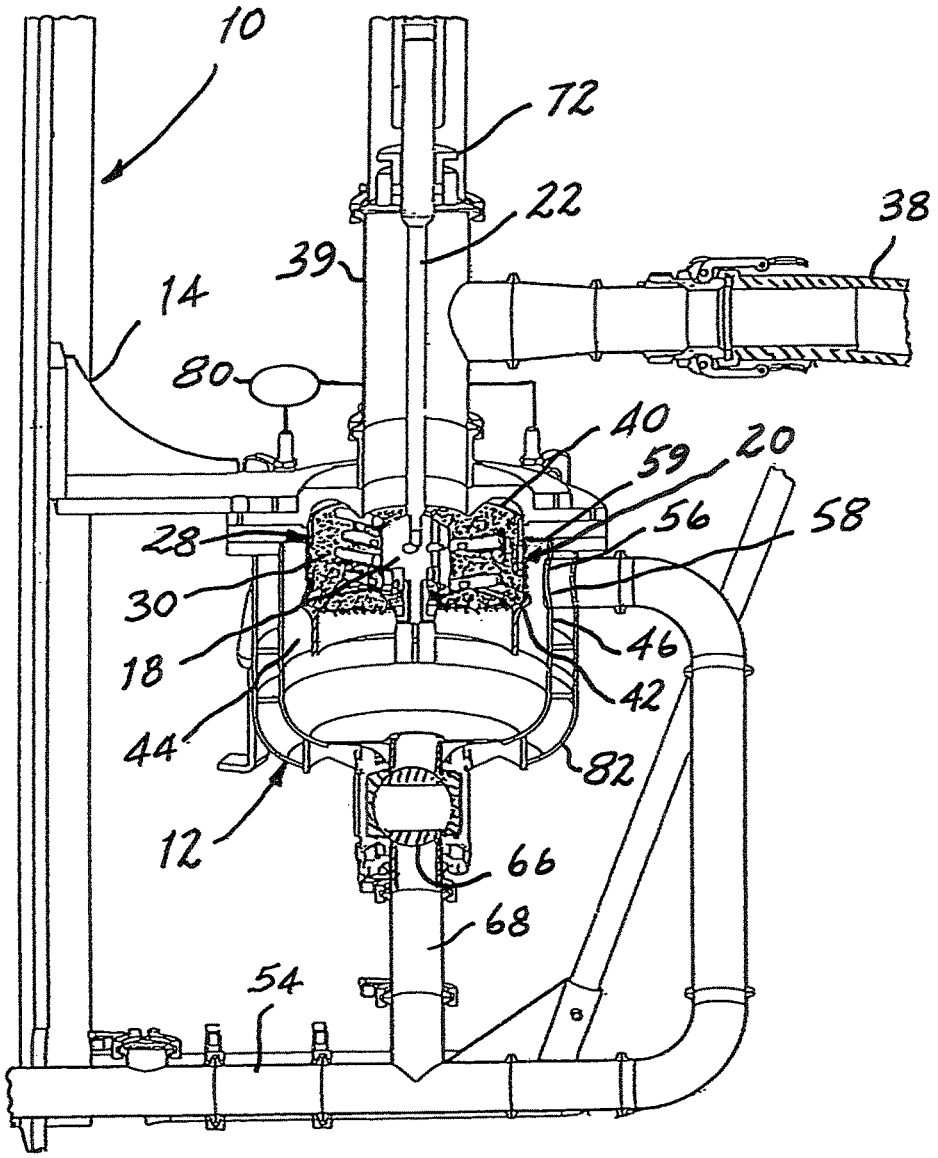
FIG. 2 is an enlarged, fragmentary, partially diagrammatic cross-sectional view of a portion of FIG. 1 designated by arrow 2 in FIG. 1.

Referring now to the drawing, an apparatus for producing a particle dispersion is shown at 10 and is seen to utilize a mill 12 carried by a frame 14 supported upon casters 16 for ease of placement of mill 12 at an appropriate processing location. Mill 12 includes a rotor 18 mounted for rotation within a containment wall 20, rotor 18 being affixed to a drive shaft 22 driven by a motor 24 carried by frame 14 and coupled to drive shaft 22 by a drive belt 26. A bed 28 of media 30 is contained within containment wall 20 for processing particle-carrying feedstock 32 passed through the bed 28 of media 30 as the feedstock 32 proceeds along a circuit within the system, as described below.

A supply vessel is shown in the form of a tank 34 and carries a supply 36 of feedstock 32 which is directed through a feed outlet 37 to a feed conduit 38 and then into a feed tube 39 where feedstock 32 is directed into the containment wall 20 and thus into the bed 28 of media 30 contained within the containment wall 20. Containment wall 20 extends longitudinally from an inlet end 40 to a terminal end 42 and is placed within an auxiliary chamber 44 having a chamber wall 46 surrounding the containment wall 20. Containment wall 20 includes screening 46 which retains the bed 28 of media 30 within containment wall 20 while allowing feedstock 32 to pass from the bed 28 of media 30 through containment wall 20 and into auxiliary chamber 44 while the media 30 is retained within the containment wall 20.

An external pumping mechanism is shown in the form of feed pump 50 having an input 52 communicating with auxiliary chamber 44 through an input tube 54 connected to an outlet 56 of the auxiliary chamber 44 at a location 58 in the chamber wall 46 of the auxiliary chamber 44. Location 58 is juxtaposed with containment wall 20 between the inlet end 40 and the terminal end 42, in juxtaposition with the inlet end 40, adjacent the upper end 59 of the auxiliary chamber 44. A return conduit 60 is connected to an output 62 of feed pump 50 and carries feedstock 32 back to tank 34 for return to supply 36 at return inlet 64. In this manner feedstock 32 is drawn from the supply 36 in tank 34, is passed into the bed 28 of media 30, then from the bed 28 of media 30 through containment wall 20 into auxiliary chamber 44, and then out of auxiliary chamber 44 to be returned to supply 36 in tank 34. With rotor 18 rotated within bed 28 of media 30 as feedstock 32 is passed through bed 28 of media 30, feedstock 32 is processed to produce a desired particle dispersion. Once completed, the fully processed feedstock 32 is delivered from tank 34 by disconnecting feed conduit 38 from feed outlet 37, by means of a manually operated clamp 65, to drain the processed feedstock 32 from tank 34. Any residual feedstock 32 remaining within auxiliary chamber 44 is drained from auxiliary chamber 44 by opening a drain valve 66, enabling such residual feedstock 32 to pass through a drain tube 68, into input tube 54 for travel to tank 34.

The processing of feedstock 32 is conducted under vacuum. To that end, a vacuum mechanism, shown in the form of vacuum pump 70, is connected to tank 34 for establishing a first negative pressure within tank 34. As the feed pump 50 draws feedstock 32 through the bed 28 of media 30, a second negative pressure is established within the auxiliary chamber 44, so that processing of the feedstock 32 is conducted at the second negative pressure, the second negative pressure being lower than the first negative pressure, creating a pressure differential that moves the feedstock 32 along the circuit through the system. In practice, the first negative pressure typically is within the range of about five to fifteen inches of vacuum and the second negative pressure typically is within the range of about ten to twenty-eight inches of vacuum. The entire system is sealed to retain the integrity of the vacuum under which the milling process is conducted, and a seal 72 serves to maintain that integrity. By processing the feedstock 32 under vacuum, that is, under negative pressure, air normally entrapped within the aggregates and agglomerates in the bed 28 of media 30 is extracted, permitting separation and wetting of the dispersed particles carried in the feedstock 32. Once separated and completely encapsulated by the vehicle of the feedstock 32, the dispersion exhibits highly improved qualitative aspects. The placement of location 58 in juxtaposition with containment wall 20 between input end 40 and terminal end 42, that is, at the side of containment wall 20 and at the upper side of auxiliary chamber 44, juxtaposed with inlet end 40 of the containment wall 20 and with the upper end 59 of the auxiliary chamber 44, throughput is increased, resulting in a reduction in processing time necessary to reach completion of a particle dispersion of exceptionally high quality.

In order to reduce any effects of heat within auxiliary chamber 44, chamber wall 46 is cooled by a cooling arrangement 80 that circulates a cooling fluid, such as water, through a jacket 82 surrounding chamber wall 46. In a similar manner, a cooling fluid, such as water, is circulated by a cooling arrangement 84 through a jacket 86 surrounding tank 34 in order to reduce any effects of heat within tank 34. Such cooling, here applied to tank 34, results in the condensation and concomitant conservation of solvents carried by feedstock 32. At the same time, any gasses or potential pollutants emanating from feedstock 32 are withdrawn by vacuum pump 70 for appropriate disposition.

Figure 3:
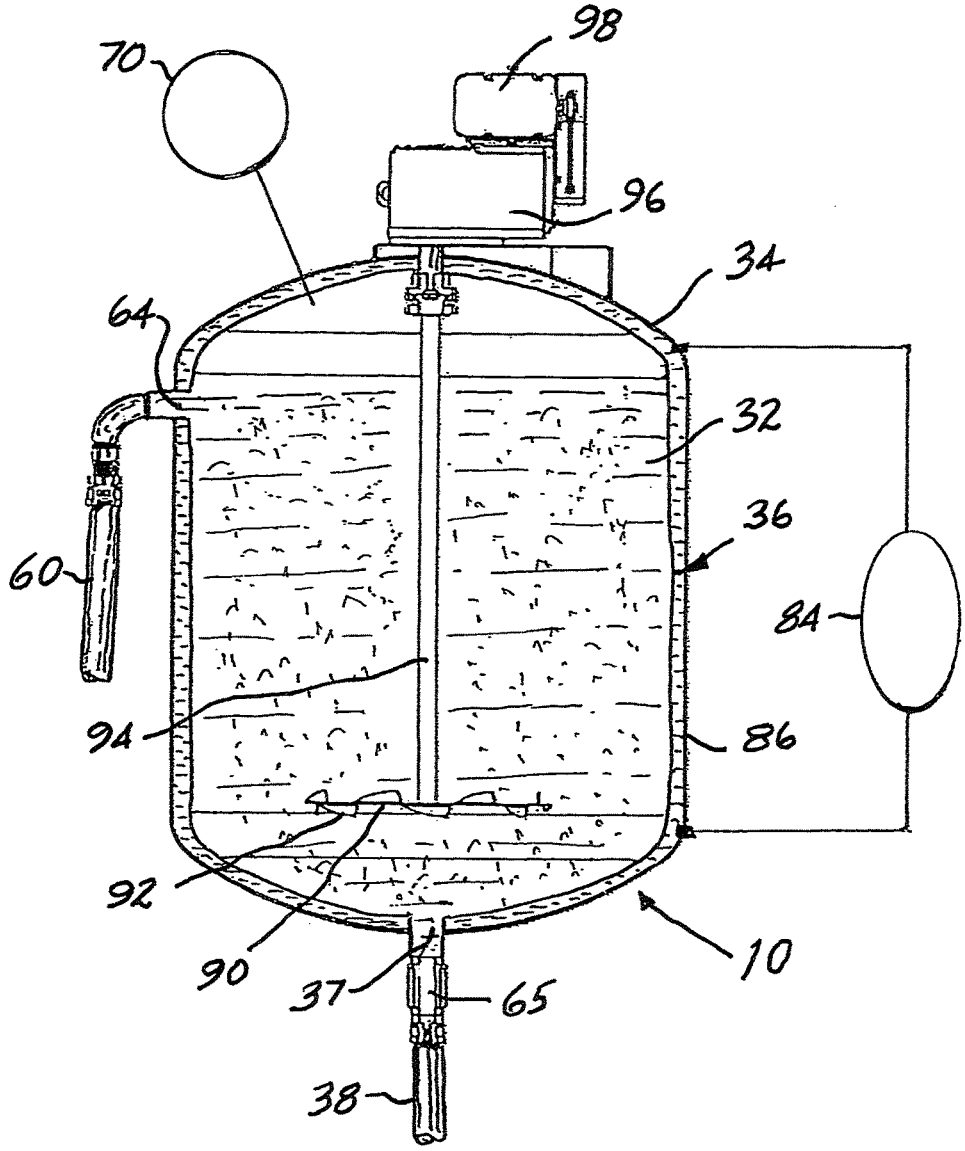
FIG. 3 is an enlarged, fragmentary, partially diagrammatic cross-sectional view of another portion of FIG. 1 designated by arrow 3 in FIG. 1.

With reference to FIG. 3, in the illustrated preferred construction, an agitator 90 is placed within tank 34 for selectively mixing the feedstock 32 during the processing operation. Agitator 90 having agitator blades 92 is mounted upon an agitator shaft 94 which is coupled for rotation by a gear drive 96 driven by a drive motor 98.

It will be seen that the present invention attains all of the objects and advantages summarized above, namely: Processes a higher volume of particle-carrying feedstock in less time to produce particle dispersions of increased, high quality; increases the effectiveness of processing a particle-carrying feedstock utilizing a bed of media contained within a containment wall through which the feedstock is passed; enables a dramatic increase in throughput of feedstock with a concomitant reduction in processing time; attains consistent high quality in particle dispersions processed in greater volumes and less processing time; avoids the emanation of unwanted gases and other potential pollutants that can be generated during the processing of a particle-carrying feedstock; simplifies the construction and operation of particle dispersion processing apparatus for increased economy and long-term reliability.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. An improvement in an apparatus for producing a particle dispersion utilizing a mill having a rotor mounted for rotation within a containment wall for processing particle-carrying feedstock passed from a supply vessel into a bed of media contained within the containment wall, the improvement comprising:

an auxiliary chamber having a chamber wall surrounding the containment wall such that feedstock will pass from the bed of media, through the containment wall and into the auxiliary chamber while the media is contained within the bed of media;

a vacuum mechanism for maintaining a first negative pressure within the supply vessel; and an external pumping mechanism communicating with the auxiliary chamber and establishing a pressure differential for drawing the particle-carrying feedstock from the supply vessel, into the bed of media, thence from the bed of media through the containment wall into the auxiliary chamber, and then out of the auxiliary chamber for return to the supply vessel, the pressure differential including a second negative pressure established within the auxiliary chamber during the processing of the particle-carrying feedstock, the second negative pressure being lower than the first negative pressure.

2. The improvement of claim 1 wherein the first negative pressure is in the range of about five to fifteen inches of vacuum.

3. The improvement of claim 1 wherein the second negative pressure is in the range of about ten to twenty-eight inches of vacuum.

4. The improvement of claim 1 wherein the containment wall extends longitudinally between an inlet end and a longitudinally opposite terminal end, and the external pumping mechanism communicates with the auxiliary chamber at a location juxtaposed with the containment wall, between the inlet end and the terminal end of the containment wall.

5. The improvement of claim 4 wherein the location is placed in juxtaposition with the inlet end of the containment wall, adjacent a corresponding end of the auxiliary chamber.

6. The improvement of claim 1 including a cooling arrangement for cooling the particle-carrying feedstock in the supply vessel.

7. An improvement in an apparatus for producing a particle dispersion utilizing a mill having a rotor mounted for rotation within a containment wall for processing particle-carrying feedstock passed from a supply vessel into a bed of media contained within the containment wall, the containment wall extending longitudinally between an inlet end and a longitudinally opposite terminal end, the improvement comprising:

an auxiliary chamber having a chamber wall surrounding the containment wall such that particle-carrying feedstock will pass from the bed of media, through the containment wall and into the auxiliary chamber while the media is contained within the bed of media; and an external pumping mechanism communicating with the auxiliary chamber at a location juxtaposed with the containment wall between the inlet end and the terminal end of the containment wall, for drawing the particle-carrying feedstock from the supply vessel, into the bed of media, thence from the bed of media through the containment wall into the auxiliary chamber, and then out of the auxiliary chamber and returned to the supply vessel, during the processing of the particle-carrying feedstock.

8. The improvement of claim 7 wherein the location is placed in juxtaposition with the inlet end of the containment wall, adjacent a corresponding end of the auxiliary chamber.

9. The improvement of claim 7 including a cooling arrangement for cooling the particle-carrying feedstock in the supply vessel.

10. A method for producing a particle dispersion utilizing a mill having a rotor mounted for rotation within a containment wall for processing particle-carrying feedstock passed from a supply vessel into a bed of media contained within the containment wall, the method comprising:

surrounding the containment wall with an auxiliary chamber having a chamber wall such that particle-carrying feedstock will pass from the bed of media through the containment wall and into the auxiliary chamber while the media is contained within the bed of media;

maintaining a first negative pressure within the supply vessel; and establishing a pressure differential for drawing the particle-carrying feedstock from the supply vessel into the bed of media, thence from the bed of media through the containment wall, and then out of the auxiliary chamber for return to the supply vessel, the pressure differential including a second negative pressure established within the auxiliary chamber during the processing of the particle-carrying feedstock, the second negative pressure being lower than the first negative pressure.

11. The method of claim 10 wherein the first negative pressure is in the range of about five to fifteen inches of vacuum.

12. The method of claim 10 wherein the second negative pressure is in the range of about ten to twenty-eight inches of vacuum.

13. The method of claim 10 including extending the containment wall longitudinally between an inlet end and a longitudinally opposite terminal end, and drawing the particle-carrying feedstock from the auxiliary chamber at a location juxtaposed with the containment wall between the inlet end and the terminal end of the containment wall.

14. The method of claim 13 including placing the location in juxtaposition with the inlet end of the containment wall, adjacent a corresponding end of the auxiliary chamber.

15. The method of claim 10 including cooling the particle-carrying feedstock in the supply vessel.

16. A method for producing a particle dispersion utilizing a mill having a rotor mounted for rotation within a containment wall for processing particle-carrying feedstock passed from a supply vessel into a bed of media contained within the containment wall, the containment wall extending longitudinally between an inlet end and a longitudinally opposite terminal end, the method comprising:

surrounding the containment wall with an auxiliary chamber having a chamber wall such that particle-carrying feedstock will pass from the bed of media, through the containment wall and into the auxiliary chamber while the media is contained within the bed of media; and establishing a pressure differential for drawing the particle-carrying feedstock from the supply vessel into the bed of media, thence from the bed of media through the containment wall into the auxiliary chamber, and then out of the auxiliary chamber at a location juxtaposed with the containment wall between the inlet end and the terminal end of the containment wall for return to the supply vessel during the processing of the particle-carrying feedstock.

17. The method of claim 16 including placing the location in juxtaposition with the inlet end of the containment wall, adjacent a corresponding end of the auxiliary chamber.

18. The method of claim 16 including cooling the particle-carrying feedstock in the supply vessel.

* * * * *